US008006498B2

(12) United States Patent
Tschirren et al.

(10) Patent No.: US 8,006,498 B2
(45) Date of Patent: Aug. 30, 2011

(54) COMBUSTION CHAMBER OF A COMBUSTION SYSTEM

(75) Inventors: Stefan Tschirren, Laufen (CH); Daniel Burri, Rothenburg (CH); Andreas Abdon, Zurich (CH); Christian Steinbach, Birmenstorf (CH)

(73) Assignee: Alstom Technology Ltd, Baden (CH)

( * ) Notice: Subject to any disclaimer, the term of this patent is extended or adjusted under 35 U.S.C. 154(b) by 217 days.

(21) Appl. No.: 12/367,908

(22) Filed: Feb. 9, 2009

(65) Prior Publication Data

US 2009/0199837 A1 Aug. 13, 2009

Related U.S. Application Data

(63) Continuation of application No. PCT/EP2007/056887, filed on Jul. 6, 2007.

(30) Foreign Application Priority Data

Aug. 7, 2006 (CH) ..... 1260/06

(51) Int. Cl.
*F02C 1/00* (2006.01)

(52) U.S. Cl. ..... 60/756; 60/752

(58) Field of Classification Search ..... 60/752–766
See application file for complete search history.

(56) References Cited

U.S. PATENT DOCUMENTS 4,321,311 A * 3/1982 Strangman ..... 428/623
5,083,424 A * 1/1992 Becker ..... 60/796
5,431,020 A * 7/1995 Maghon ..... 60/753
5,490,389 A * 2/1996 Harrison et al. ..... 60/737
6,047,552 A 4/2000 Gross et al.
6,276,142 B1 * 8/2001 Putz ..... 60/752
6,675,586 B2 * 1/2004 Maghon ..... 60/796
7,007,489 B2 * 3/2006 Schulten ..... 60/796
2003/0056515 A1 * 3/2003 Bast et al. ..... 60/752
2004/0050060 A1 * 3/2004 Taut ..... 60/752

(Continued)

FOREIGN PATENT DOCUMENTS

DE 8618859 1/1998

(Continued)

OTHER PUBLICATIONS

International Search Report for International No. PCT/EP2007/056887 mailed on Mar. 4, 2008.

(Continued)

*Primary Examiner* — Michael Cuff
*Assistant Examiner* — Gerald L Sung
(74) *Attorney, Agent, or Firm* — Leydig, Voit & Mayer, Ltd.

(57) ABSTRACT

A combustion chamber of a combustion system comprises a combustion space, a support structure, a heat shield, and at least one through-opening. The heat shield has at least two segments, and each segment has an edge region, a gap communicating with the combustion space being formed between edge regions of adjacent segments, and a retaining device. The adjacent segments include a support element disposed in a bottom region of the gap. The retaining device fixes the respective liner element on the support structure via the respective support element. The at least one through-opening communicates with the gap so as to enable a cooling gas to flow through the through-opening. The at least one through-opening is disposed in at least one of the respective edge region and the support element at the bottom region of the gap.

10 Claims, 1 Drawing Sheet

U.S. PATENT DOCUMENTS

| | | | | |
|---|---|---|---|---|
| 2004/0182085 | A1 * | 9/2004 | Jeppel et al. | 60/804 |
| 2007/0245742 | A1 * | 10/2007 | Dahlke et al. | 60/754 |
| 2009/0056339 | A1 * | 3/2009 | Fischer et al. | 60/752 |
| 2009/0077974 | A1 * | 3/2009 | Dahlke et al. | 60/752 |

FOREIGN PATENT DOCUMENTS

| | | | |
|---|---|---|---|
| DE | 19727407 | | 1/1999 |
| EP | 1022437 | | 7/2000 |
| EP | 1143109 | | 10/2001 |
| EP | 1477737 | | 11/2004 |
| EP | 1507116 | | 2/2005 |
| GB | 2298267 | | 8/1996 |
| WO | WO-9813645 | | 4/1998 |
| WO | WO2006045758 | * | 5/2006 |

OTHER PUBLICATIONS

Co-pending U.S. Appl. No. 12/367,997.

* cited by examiner

COMBUSTION CHAMBER OF A COMBUSTION SYSTEM

This application is a continuation of International Patent Application No. PCT/EP2007/056887, filed on Jul. 6, 2007, which claims priority to Swiss Patent Application No. CH 01260/06, filed on Aug. 7, 2006. The entire disclosure of both applications is incorporated by reference herein.

The invention refers to a combustion chamber of a combustion system, especially of a gas turbine, with a heat shield which has at least two segments.

BACKGROUND

Combustion chambers of a combustion system, for example of a gas turbine, are customarily equipped with a heat shield which protects a subjacent support structure against a direct contact with a hot gas flow. Depending upon position in the combustion chamber, or with regard to the hot gas flow, the heat shield, or individual segments of it, in this case is or are exposed to a variable temperature stress.

SUMMARY OF THE INVENTION

For the longevity of the combustion system, the longevity of the heat shield which is arranged in the combustion chamber is important so that the functional capability of the heat shield is ensured. Since modern heat shields customarily comprise a plurality of segments with a plurality of liner elements, gaps are formed between two adjacent liner elements into which a hot gas flow can penetrate. At a bottom of the gap, a support element is often arranged, which on the one hand supports at least one liner element, and on the other hand, in an unfavorable case, is not protected by the liner element against a direct entry contact with the hot gas flow and is therefore exposed to this without protection. Such gaps form potential weak points. In order to ensure the longevity of the combustion system, the gaps between the liner elements should be protected against an excessively large temperature stress.

The present invention provides an improved embodiment for a combustion chamber. The embodiment is characterized by locally adapted cooling of a heat shield.

The present invention is based on the general idea of locally cooling a gap which is arranged between two liner elements of a heat shield and open towards a combustion space and as a result, effectively protects a support element, which is arranged in the region of a gap bottom against a direct hot gas action. The heat shield, which is provided for temperature protection, has at least two segments, of which each one comprises a liner element, which faces a combustion space, and a retaining device, which fixes the liner element on a support structure via a support element. In this case, each liner element has an edge region, which at the same time forms a wall of a gap. The gap is located between two liner elements and open towards the combustion space. In the region of a gap bottom, a support element is arranged in this case, which closes off the gap on its side and faces away from the combustion space. For cooling the edge regions of the liner elements that face the gap, in this case in at least one edge region of a liner element and/or in the bottom, i.e. for example in the support element, at least one through-opening is provided, through which cooling gas flows into the gap and, as a result, brings about a film cooling of the gap walls which are formed by the two edge regions of the adjacent liner elements. As a result of this, an effective cooling of the gap can be achieved without significantly increasing the oxygen content in the combustion space and consequently without increasing the NOx emissions of the combustion system. It is also conceivable in this case that such a through-opening is provided in only one of the two edge regions of the liner elements, in the two edge regions, only in the gap bottom or at least in one edge region and in the bottom, so that depending upon locally required cooling requirement the cooling can be adapted by different arrangement of the through-openings. As a result of the locally adapted cooling flow, a particularly effective cooling of the gap can be achieved, wherein in gaps with increased cooling requirement more gas is introduced than in gaps with lower cooling requirement. Consequently, the efficiency of the combustion system is not decreased as a result of an excessively intense cooling of the liner elements or of the gaps.

The edge region of the liner element expediently fits under a flange region, which is formed by the retaining device. This enables a reliable mounting of the liner element on the support element or on the support structure via the retaining device, wherein in comparison to a direct screw fastening temperature expansions can be accommodated in a problem-free manner. Such a mounting of the liner elements thus reduces the risk of excessively high stresses as a result of temperature expansions and therefore contributes to the longevity of the combustion system.

In an advantageous development of the solution according to the invention, at least the edge regions of the liner elements and/or the support element in the region of the gap bottom have a thermal barrier coating. Such a thermal barrier coating improves the resistance of the liner elements or of the support element to a temperature stress which results from the hot gas flow and consequently increases the service life of the liner elements. The improved resistance of the liner elements or of the support element to a temperature stress, as result of the thermal barrier coating, also reduces a maintenance requirement since the thermal barrier coatings extend the service lives of the liner elements or of the support elements. Extended service lives extend the maintenance intervals, as a result of which the downtimes of the combustion system can be significantly reduced and the combustion system itself can be operated more cost-effectively.

Further important features and advantages of the combustion chamber according to the invention result from the claims, from the drawings, and from the associated figure description with reference to the drawings.

BRIEF DESCRIPTION OF THE DRAWINGS

Exemplary embodiments of the invention are shown in the drawings and are explained in more detail in the following description, wherein like designations refer to the same, or similar, or functionally the same components.

In this case, in the drawing, schematically in each case.

DETAILED DESCRIPTION OF THE EXEMPLARY EMBODIMENTS

Figure 1:
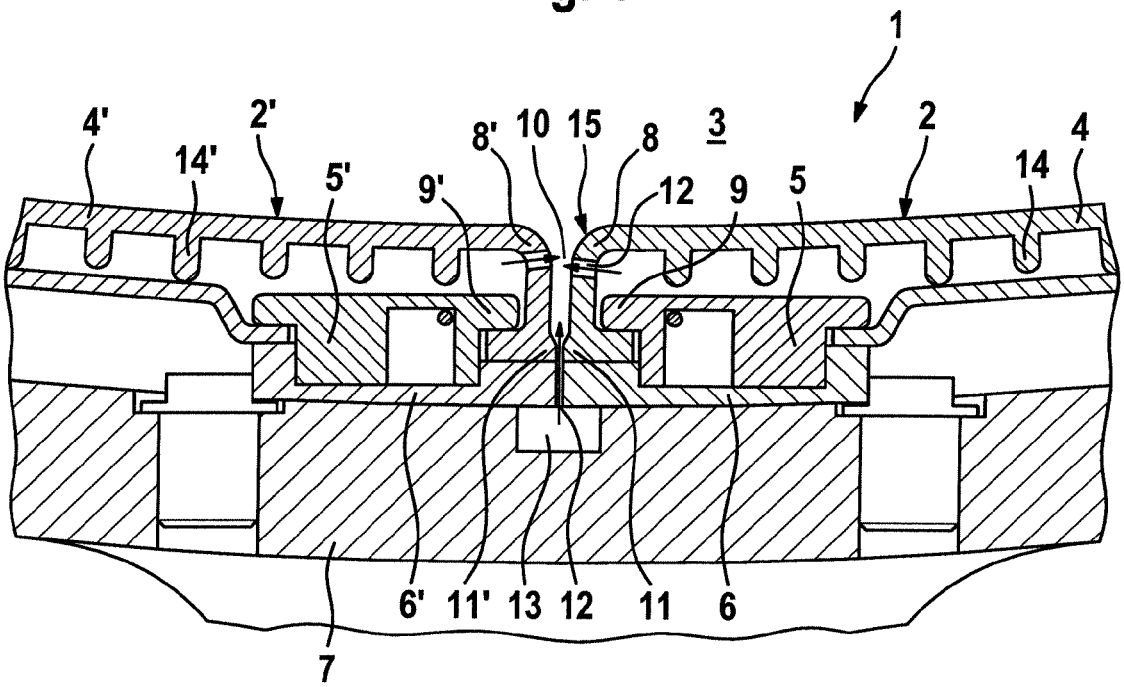
FIG. 1 shows a sectional view through a heat shield, according to the invention, of a combustion chamber.

In accordance with FIG. 1, a sectional view through a combustion chamber wall of a combustion system, especially of a gas turbine, is shown, with a heat shield 1 which has at least two segments 2 and 2' which are arranged next to each other. The two segments 2, 2' in each case have a liner element 4 or 4', which faces a combustion space 3, and a retaining device 5, 5'. The liner element 4 in this case, as well as the liner element 4', is formed from a material which is not affected by heat so that it withstands in a problem-free manner a direct contact with hot gases which are present in the combustion space 3. The two liner elements 4, 4' are fixed on a support structure 7 via at least one support element 6, wherein the retaining device 5 fixes both the liner element 4 and the at least one support element 6 on the support structure 7. In this case, fastening of the liner element 4 on the retaining device 5 is carried out by means of an edge region 8 which is formed on the liner element 4 and fits in an undercut-like manner under a flange region 9 which is formed by the retaining device 5.

According to FIG. 1, a gap 10 is provided between two adjacent liner elements 4, 4', which is open towards the combustion space 3 and is for accommodating thermal expansions of the two liner elements 4, 4', and in which hot gas can penetrate during operation of the combustion chamber and leads to a high temperature stress there. On its side which faces away from the combustion space 3, the gap 10 is closed off by a gap bottom which for example is formed by one or more support elements 6, 6'. In this case, depending upon construction of the liner element 4, 4' in the gap region, hot gas which has flowed into the gap 10 acts on a gap base almost directly upon the support element 6 or 6' and can have a detrimental effect upon this with regard to its function if the gap base is not protected against a direct contact with the hot gas flow by oppositely disposed flange regions 11, 11' of the two liner elements 4, 4'.

For cooling the edge regions 8, 8' of the two liner elements 4, 4' which face the gap, at least one through-opening 12, through which cooling gas can flow into the gap 10, is provided in the edge region 8 of at least one liner element 4 or 4' and/or in the bottom, i.e. in the support element 6. The cooling gas which has reached the gap in this case is first used for cooling the two liner elements 4, 4', or flows directly from the cooling gas passage 13 through the support element 6 or between two adjacent support elements 6, 6' into the gap 10. For improved cooling of the two liner elements 4, 4', these have cooling ribs 14, 14' on their side which faces away from the combustion space 3. The through-opening 12 between the cooling gas passage 13 and the gap base of the gap 10 in this case can be formed either as a through-hole or through-opening 12 through a one-piece support element 6, or as a gap passage between two adjacent support elements 6, 6', as result of which an even cooling of the gap 10 along the gap 10 is achieved.

In order to be able to protect both the support element 6 and the support structure 7 better against the heat effect of the hot gas flow, at least the edge regions 8, 8' of the liner elements 4, 4' and/or the support element 6 or 6' have a thermal barrier coating in the region of the gap bottom. This reduces the susceptibility to a temperature stress and increases the resistance of the components which are coated with the thermal barrier coating.

Figure 2:
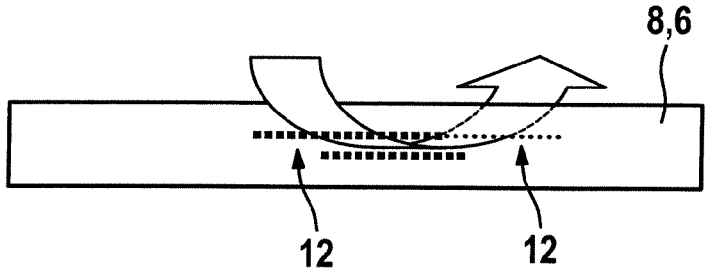
FIG. 2 shows a possible arrangement of through-openings in the gap.

As is to be additionally gathered from FIG. 1, through-openings 12, through which cooling gas can penetrate into the gap 10, are provided both in the two edge regions 8, 8' and in the region of the gap bottom of the gap 10. Alternatively to this, it is conceivable that through-openings 12 are provided either in only one edge region 8 or 8' or only in the region of the gap bottom, or any combination of through-openings 12 is provided, so that for example only the edge regions 8 and/or 8' or only the gap bottom, or exclusively one edge region 8, 8', etc., have through-openings 12, depending upon the necessary cooling requirement. In the case of an increased cooling requirement, it can also be provided that the edge region 8 or 8' of the liner element 4 or 4' and/or the support element 6 in the region of the gap bottom have at least one row of through-openings 12 which extends parallel to the gap 10 (cf. FIG. 2). As used herein, extending parallel to the gap shall mean that the row of through-openings extends parallel to, or essentially parallel to, the gap. In this case, via a spacing or a diameter of the individual through-openings 12, influence can be brought to bear on the volume of cooling gas which flows into the gap and consequently influence brought to bear on the cooling of the gap 10 itself. In this way, it is conceivable that in the case of a reduced cooling requirement provision is made for only one row with a plurality of through-openings 12 which, however, lie far apart from each other and are formed with a small diameter, whereas in the case of a high cooling requirement provision is made for a plurality of rows with through-openings 12 which lie close to each other and in each case have a large diameter. In this case, it is especially possible to create a predefined cooling gas flow by means of a corresponding orientation of the through-openings 12 in the edge region of the liner element 4, 4' and/or in the support element 6, 6' so that it is conceivable that the through-openings 12 extend at an angle to the gap 10 and consequently create a film cooling which acts along the edge regions 8, 8' of the liner elements 4, 4'.

In order to also absorb stress peaks, especially in the transition region 15 of the liner element 4 between the gap 10 and combustion space 3, or to achieve improved cooling of the transition region 15, this can be constructed in a rounded manner.

As a result of the solution according to the invention, with an arrangement of through-openings 12 in the gap 10, which is adapted to a necessary cooling requirement in each case, cooling, especially film cooling which is adapted to the necessary cooling requirement in each case, can be achieved, which, on the one hand, sufficiently cools the gap 10 with the adjacent liner elements 4, 4' and also with the support element 6, and on the other hand, only just enough cooling gas enters the gap 10 or the combustion space 3 as is absolutely necessary for cooling. An excessively high cooling gas flow, which is associated with a reduced efficiency of the combustion system which accompanies it, can be prevented as a result, as well as an excessively high NOx emission of the combustion system.

LIST OF DESIGNATIONS

1 Heat shield
2 Segments
3 Combustion space
4 Liner element
5 Retaining device
6 Support element
7 Support structure
8 Edge region
9 Flange region
10 Gap
11 Flange region of the liner elements 4 in the gap region
12 Through-opening
13 Cooling gas passage
14 Cooling ribs
15 Transition region

What is claimed is:

1. A combustion chamber of a combustion system, the combustion chamber comprising: a combustion space;

a support structure;

a heat shield with at least two segments, each segment including a liner element facing the combustion space and having an edge region, a gap communicating with the combustion space being formed between edge regions of adjacent segments, each of the liner elements being mounted to a support element disposed in a bottom region of the gap, and each of the heat shield segments including a retaining device fixing an edge region of the respective liner element on the support structure via the respective support element;

at least one through-opening communicating with the gap so as to enable a cooling gas to flow through the through-opening into the gap thereby cooling a respective one of the edge regions facing the gap, wherein the at least one through-opening is disposed in at least one of the respective edge region and the support element at the bottom region of the gap wherein the retaining device has a flange region, and wherein the edge region of the respective liner element fits under the flange region.

2. The combustion chamber as recited in claim 1, wherein at least one of the edge region and the support element have a thermal barrier coating.

3. The combustion chamber as recited in claim 1, wherein the at least one through opening includes a row of through-openings extending parallel to the gap.

4. The combustion chamber as recited in claim 1, wherein the liner element has at least one cooling rib disposed on a side of the liner element facing away from the combustion space.

5. The combustion chamber as recited in claim 1, wherein the at least one throughopening extends at an angle to the gap so to create a predefined cooling gas flow.

6. The combustion chamber as recited in claim 1, wherein the liner element has a rounded transition region between the gap and the combustion space.

7. The combustion chamber as recited in claim 1, wherein the combustion system is a gas turbine.

8. A combustion system, comprising:

a combustion chamber that includes:

a combustion space;

a support structure;

a heat shield with at least two segments, each segment including a liner element facing the combustion space and having an edge region, a gap communicating with the combustion space being formed between edge regions of adjacent segments, each of the liner elements being mounted to a support element disposed in a bottom region of the gap, and each of the heat shield segments including a retaining device fixing an edge region of the respective liner element on the support structure via the respective support element;

at least one through-opening communicating with the gap so as to enable a cooling gas to flow through the through-opening into the gap thereby cooling a respective one of the edge regions facing the gap, wherein the at least one through-opening is disposed in at least one of the respective edge region and the support element at the bottom region of the gap wherein the retaining device has a flange region, and wherein the edge region of the respective liner element fits under the flange region.

9. The combustion chamber as recited in claim 1, wherein the at least one through-opening is disposed in the support element at a bottom of the gap.

10. The combustion system as recited in claim 8, wherein the at least one through-opening is disposed in the support element at a bottom of the gap.

* * * * *